US005623792A

United States Patent [19]

Crumpacker

[11] Patent Number: 5,623,792

[45] Date of Patent: Apr. 29, 1997

[54] GRAVE MARKER LEVELING

[76] Inventor: William H. Crumpacker, 1538 School Ave., Walla Walla, Wash. 99362

[21] Appl. No.: 653,282

[22] Filed: May 24, 1996

[51] Int. Cl.[6] ..... E04B 1/04

[52] U.S. Cl. ..... 52/126.7; 52/103; 52/126.1; 52/126.5; 52/126.6; 52/169.13; 52/705; 52/707; 52/741.14; 52/742.14; 52/742.15

[58] Field of Search ..... 52/103, 126.5, 52/126.1, 126.6, 126.7, 125.1, 169.13, 741.14, 742.15, 742.14, 704, 705, 707

[56] References Cited

U.S. PATENT DOCUMENTS

| | | | |
|---|---|---|---|
| 343,671 | 6/1886 | Miles | 52/103 |
| 1,843,602 | 2/1932 | Holmes | 52/103 X |
| 3,511,001 | 5/1970 | Morgan, Jr. | 52/126.5 |
| 4,348,841 | 9/1982 | Ueno et al. | 52/126.5 |

*Primary Examiner*—Christopher T. Kent
*Attorney, Agent, or Firm*—Wells, St. John, Roberts Gregory & Matkin, P.S.

[57] ABSTRACT

A grave marker and grave marker footing leveling device is described, in which an elongated threaded rod is provided with a tool engagement head at a top end. A footing lifting abutment is located on the rod spaced toward the bottom rod end. A nut is threadably engaged with the threads and is spaced toward the bottom end of the rod from the abutment. A tubular spike rotatably receives and covers an axial length of the rod from the nut to the bottom end of the rod. In a preferred process step, the rod is placed in position within an excavation including a footing depression and a sub-footing depression. Wet concrete fills the sub-footing depression up to a level at which the nut on the device is captured. An impervious sheet is spread over the wet concrete in the sub-footing, before the grave marker and footing are set. In alternate forms the device is provided individually, as an element in a combination with a grave marker and footing.

21 Claims, 8 Drawing Sheets

26
24
23
18
22
15
16
37
20
28
36
34
32
17
30
42
43
X
44
40
38
50
46
48

GRAVE MARKER LEVELING

TECHNICAL FIELD

The present invention relates to grave markers and particularly to leveling of grave markers.

BACKGROUND OF THE INVENTION

The ground at many cemetery sites is relatively soft and is selected that way so graves can be excavated easily. Soft earth is not suitable to continuously support heavy grave markers. Thus it is not uncommon for settling to occur. This can be a matter of the marker settling evenly below the ground surface, or settling angularly so the marker becomes "out of plumb" and depressed with respect to the level of the surrounding sward. The latter is especially a problem for tall gravestones.

The above situation is unsightly and undesirable for the purchaser of the marker, and for the individuals hired to set the marker. However, there has been no means known to the present inventor, short of extensive excavation and concrete work, for re-leveling settled grave markers.

In the past, various devices have been produced for mounting grave stones to footings. However, these devices do not include readily accessible apparatus that will enable leveling of the marker once settling occurs. A need has remained for a device that can be used both for installation of grave markers, to enable later leveling procedures; and as a tool for leveling an existing in-situ grave marker that has settled.

As will be understood below, the present invention provides a solution to the above problem, by providing a device and process by which new and existing, previously set grave markers can be leveled periodically from above the ground surface using minimal excavation efforts and with common tools, without disturbing the surrounding sward and without leaving any unsightly structure projecting above the marker or footing.

BRIEF DESCRIPTION OF THE DRAWINGS

Preferred embodiments of the invention are described below with reference to the following accompanying drawings.

FIG. 10 is a fragmented exploded perspective view of the preferred leveling device;

DETAILED DESCRIPTION OF THE PREFERRED EMBODIMENTS

Figure 1:
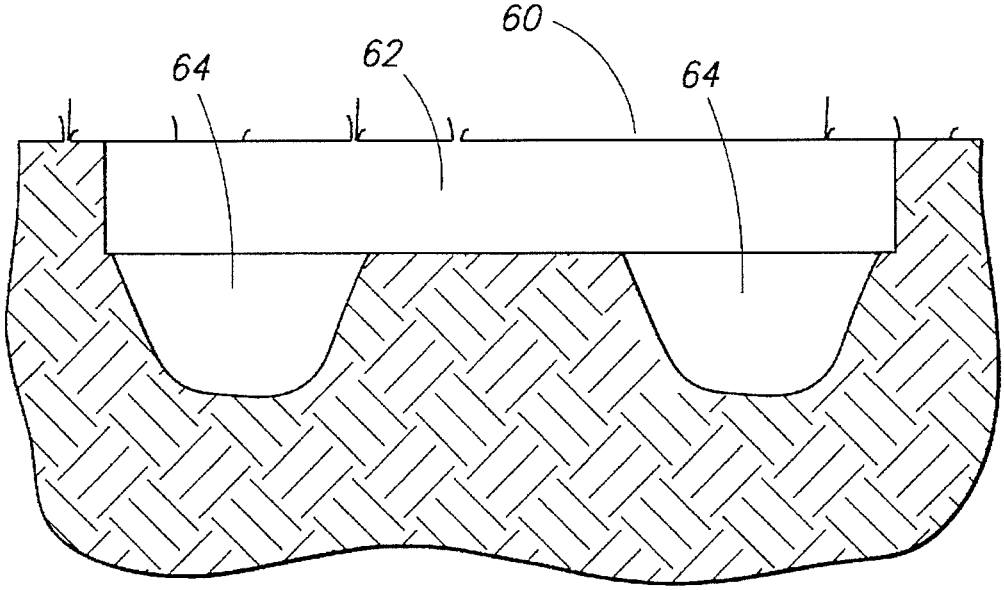
FIG. 1 is a diagrammatic view showing a presently preferred grave marker excavation including a footing excavation and sub-footing excavations for use in the present invention.

This disclosure of the invention is submitted in furtherance of the constitutional purposes of the U.S. Patent Laws "to promote the progress of science and useful arts" (Article 1, Section 8).

In referring in general to the drawings, a grave marker 10 is shown in sectional view by FIGS. 5–8 of the drawings. For purposes of this disclosure, the marker 10 should be understood as being any form of marker, and that the drawings merely exemplify one form. Further, it should be understood that the marker 10 may be produced separately from or substantially integrally with a footing 11. In other words, the footing 11 may either be an integral part of the marker 10, or formed about the marker 10 as shown in the drawings.

In some instances, the monument installer will combine the marker 10 with the footing 11, by casting the footing about the monument at a facility some distance from the installation site. The integrated combination (grave marker 10 and footing 11) are then transported to a grave site for installation. In other instances the grave marker 10 is set in a footing 11 that is poured at the grave site as shown in the sequence of FIGS. 2–6.

Figure 9:
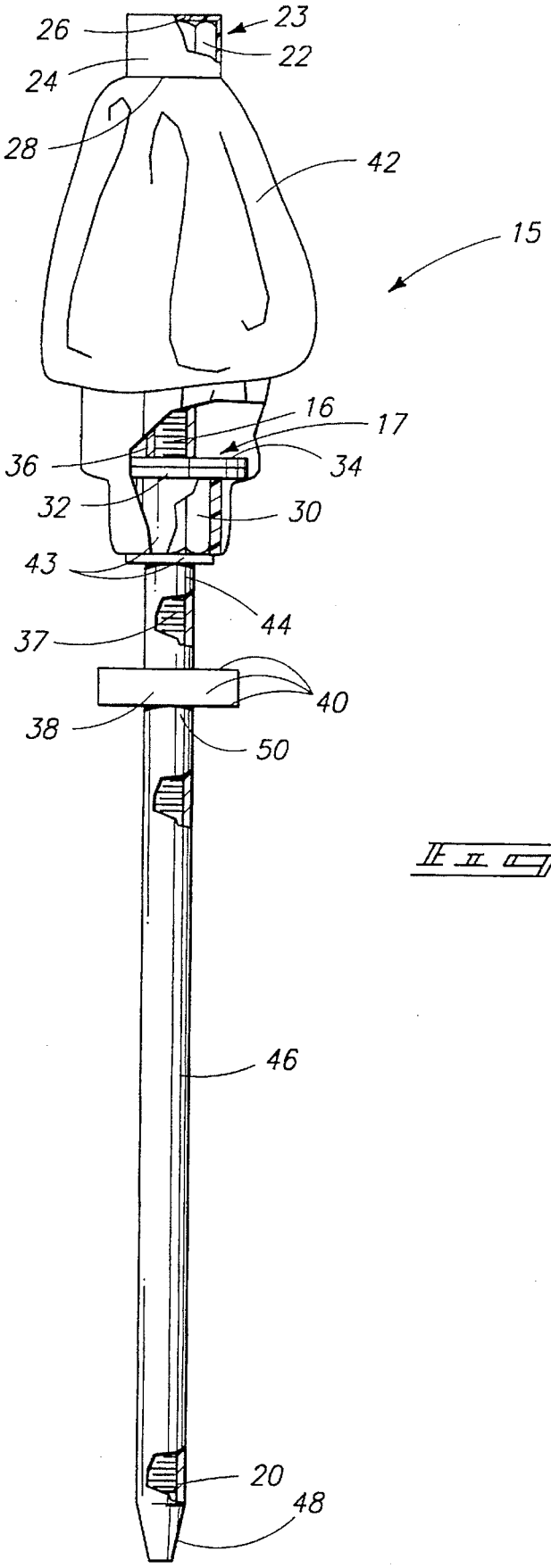
FIG. 9 is an enlarged partially fragmented elevation view of a presently preferred form of the leveling device.
Figure 12:
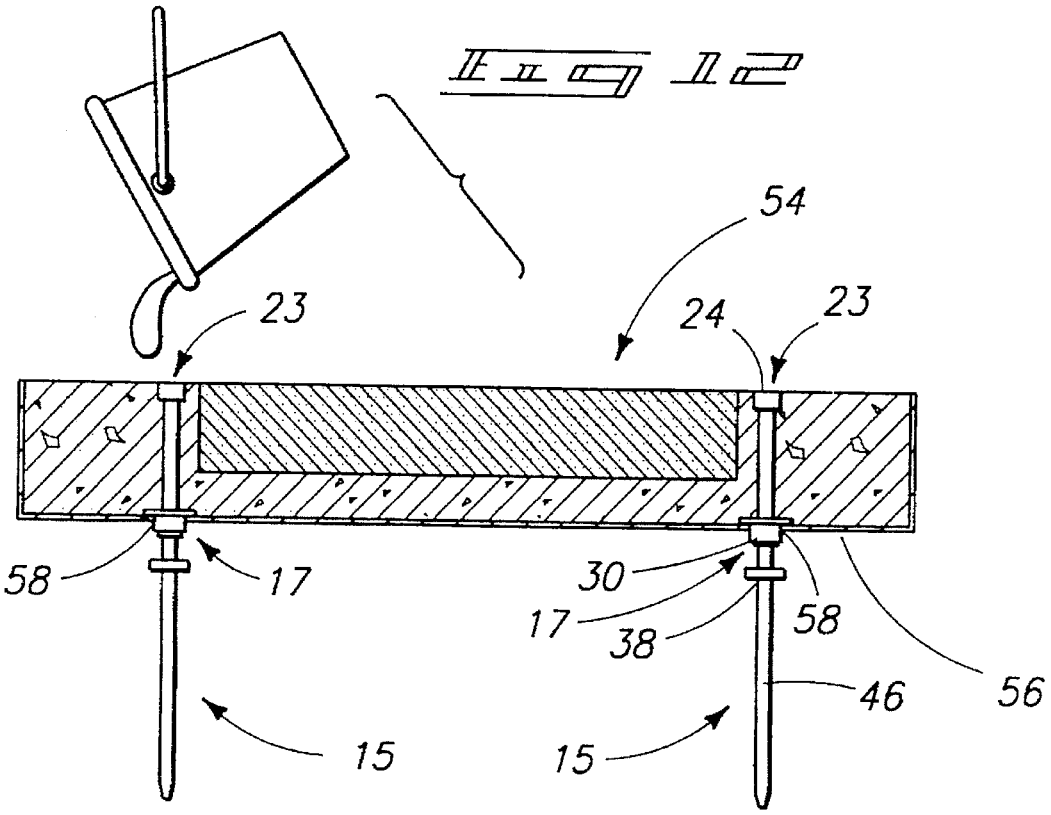
FIG. 12 is a view showing formation of a combination in which leveling devices are integrated with a marker and footing.

It should be understood that forms of the present device 15 may be produced individually, separately from a grave marker 10, as shown in FIG. 9. Alternatively, the present devices 15 can be produced in combination with a marker 10 and footing 11 (FIG. 12, 13) at a site remote from the grave site.

In a first preferred form the present device 15 includes an elongated rod 16, extending along an axis X (FIG. 10) from a top end 18 to a bottom end 20. A tool engagement head 22 is provided at the top end 18 of the rod 16. In practice, the rod 16 may be a common bolt, in which the integral tool engagement head 22 is an ordinary hex-head commonly found on commercial bolts. Other equivalent forms of tool engaging heads may be selected, including screw heads, allen bolt heads, or the like.

It is preferred that the rod be formed of steel, coated with a non-corrosive material such as zinc, or that it be formed of a strong non-corrosive material such as stainless steel. The length and diameter of the rod 16 may vary with required applications. For example a longer, larger diameter rod may be used with heavy grave markers, while lighter units may be used for smaller markers. Preferably, however, a common size will be produced, with different marker weights being accommodated by using more or fewer devices 15.

In one preferred form, a liquid impervious cap 24 is slidably received axially over the head 22. The cap 24 may be formed of an appropriate plastic material, with a closed end 26 for releasably covering the head 22. In use, the caps 24 will prevent corrosion of the rod 16 from exposure, and will further prevent formation of concrete against the heads 22 during the setting process.

In a preferred form, a washer 28 is provided on the rod 16 below the head 22. The washer 28 is preferably also formed of plastic and may be sized to substantially seal against the cap 24. In use, the washer 28 will allow free rotation of the rod 16 by preventing concrete from bonding against the head 22 from below.

FIGS. 9 and 10 illustrate an exemplary footing lifting abutment 30 on the rod 16, spaced toward the bottom rod end 20 from the tool engagement head 22. The abutment 30 is used in operation to engage and transmit lifting (or lowering) forces to the marker 10. In the illustrated embodiment, the abutment 30 is a nut, welded or otherwise affixed to the rod. The axial location of the abutment along the rod is determined so that the top surface of the abutment 30 will engage against the bottom surface of the marker or footing when properly set.

Advantageously, the abutment is capped by at least one footing engaging and lifting washer 32. Preferably two or more such washers 32 are rotatably mounted to the rod 16 and are movably supported by the abutment 30. The washers 32 extend radially outwardly from rotatable engagement with the rod to present large, flat lifting surfaces 34 for engaging the marker 10, footing 11 or both.

Preferably, a tubular shield 36 is provided, rotatably enclosing an axial extent of the rod 16 from the abutment 30 to the head 22. The shield 36 is used to keep the marker or footing material from inhibiting rotation of the rod when in use. The washers 28 and 32 cap the top and bottom ends of the shield 36 and thereby prevent materials such as wet concrete from seeping into the ends of the shield and bonding with the rod.

Threads 37 are formed in the rod 16 between the abutment 30 and bottom end 20. Standard bolt threads may be turned or otherwise formed by conventional means into the rod material. It is advantageous from a purchasing standpoint that the threads 37 be continuous from the head 22 to the bottom 20 of the rod, since bolts commonly are threaded in this manner. However only that part of the threads 37 below the abutment 30 are actively used in the present leveling process.

A nut 38 is threadably engaged with the threads 37 and is spaced toward the bottom rod end 20 from the abutment 30. As shown, the preferred nut 38 includes areal concrete anchoring surfaces 40. These surfaces 40 are enlarged in comparison to standard hex nuts, so the nut 38 can be firmly anchored in a concrete sub-footing (to be described in greater detail later). It is preferred that the nut 38 be coated with a non corrosive material like the rod 16, or be made of a rigid non-corrosive material such as stainless steel. The bore of the nut includes appropriate mating threads for turning engagement by the threads 37 on the rod.

Figure 4:
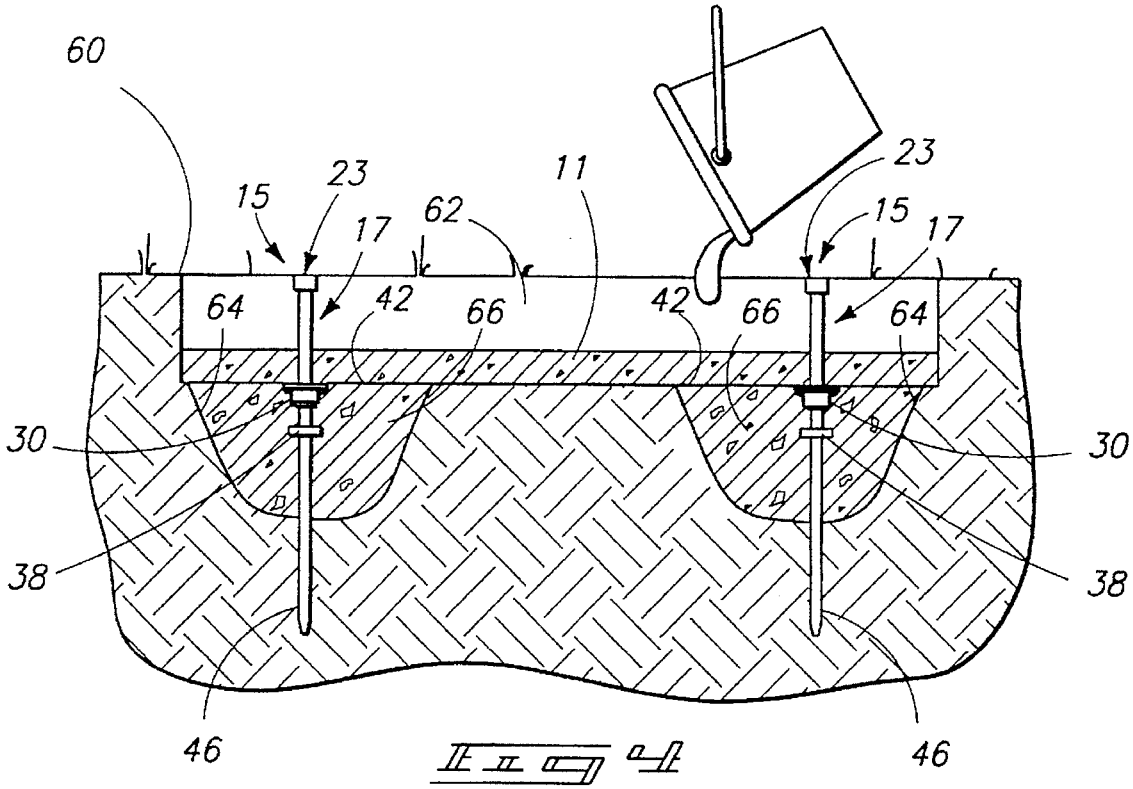
FIG. 4 is a view in progression from FIG. 3 showing pouring of a footing over the sub-footing.

In one preferred form of the present device, a flexible liquid impervious sheet 42 is mounted to the rod 16 between the nut 38 and abutment 30. The sheet may be a conventional "ground cover" type material of at least three mill thickness and have sufficient dimension to cover the area immediately surrounding the rod 16. The sheet 42 is foldable from a storage condition shown in FIGS. 2 and 3, to a flattened condition substantially normal to the axis X as shown in FIG. 4. In use, the sheet 42 prevents bonding of materials, and encourages independent movement of the marker and footing relative to the surrounding ground and sub-footing. A plastic intermediate cup and washer assembly 43 may be provided to cover the abutment 30 and secure the sheet in relatively sealed position along the rod 16.

A spacer tube 44 rotatably encircles the rod 16 and extends between the abutment 30 (preferably just below the intermediate cup and washer assembly 43) and nut 38. This tube 44 is preferably formed of a rigid material such as galvanized steel and is used to protect the threads 37 against bonding with adjacent materials. It thereby helps keep the rod free for rotation when in use. It is also used to fix the axial location of the nut 38 with respect to the abutment 30. The nut 38 will thus be spaced a prescribed distance below the abutment to assure anchorage within the sub-footing.

A tubular spike 46 rotatably receives and covers the axial length of rod 16 from the nut 38 to the bottom end 20 of the rod. Like the spacer tube 44, spike 46 is preferably rigid and formed of material such as galvanized steel. The preferred tubular spike 46 includes a closed, pointed bottom end 48 adapted to be driven into a ground surface, and an open top end 50 for rotatably and releasably receiving that part of the rod 16 extending below the nut 38. The spike 46 protects the threads 37 during the driving step shown graphically in FIG. 2, and permits free rotation of the rod when in use.

Operation of the above described device may be understood in conjunction with the following description of the presently preferred process.

Figure 13:
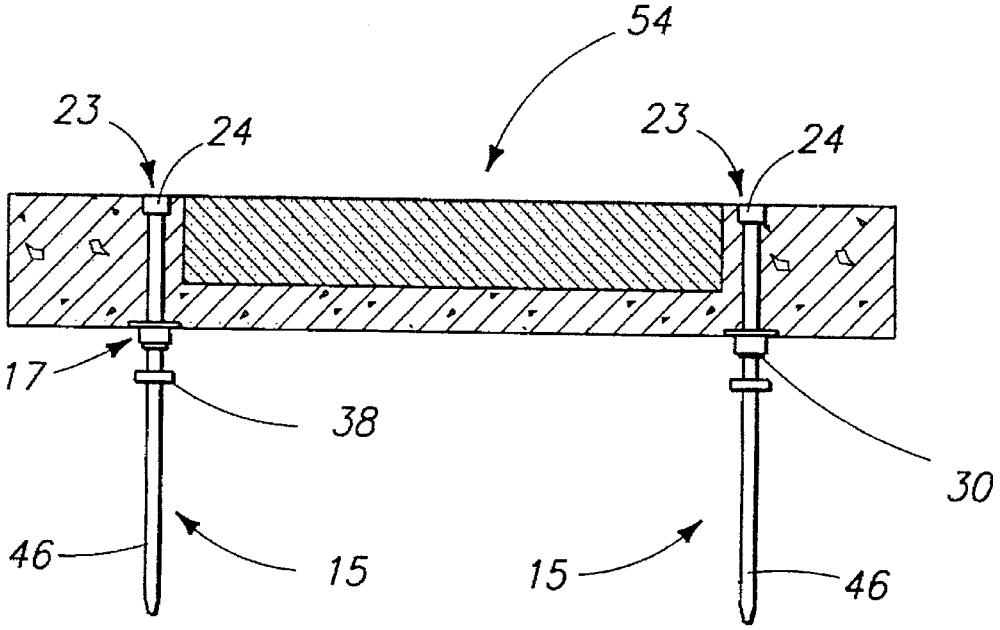
FIG. 13 is a view of the completed combination, ready for installation at a grave site.

The preferred process includes a succession of steps carried out substantially in the manner as exemplified in FIGS. 1–6. The process may be varied in the order of the steps performed, and the site at which the various steps occur. For example, FIGS. 1–6 show all the process steps being carried out at the grave site. However, alternate steps utilizing a combination 54 of a marker 10, footing 11, and device 15 (as shown by FIG. 13) may occur at a separate location, and will be described separately below.

In the first preferred process, an initial step includes that of excavating a grave marker ground site 60 to include a footing receiving depression 62 and a sub-footing depression 64 within the footing receiving depression 62. This step is graphically illustrated in FIG. 1 and can be accomplished using conventional appropriate excavating equipment. The footing depression 62 is excavated to a depth slightly greater than the thickness dimension of the marker 10.

Figure 2:
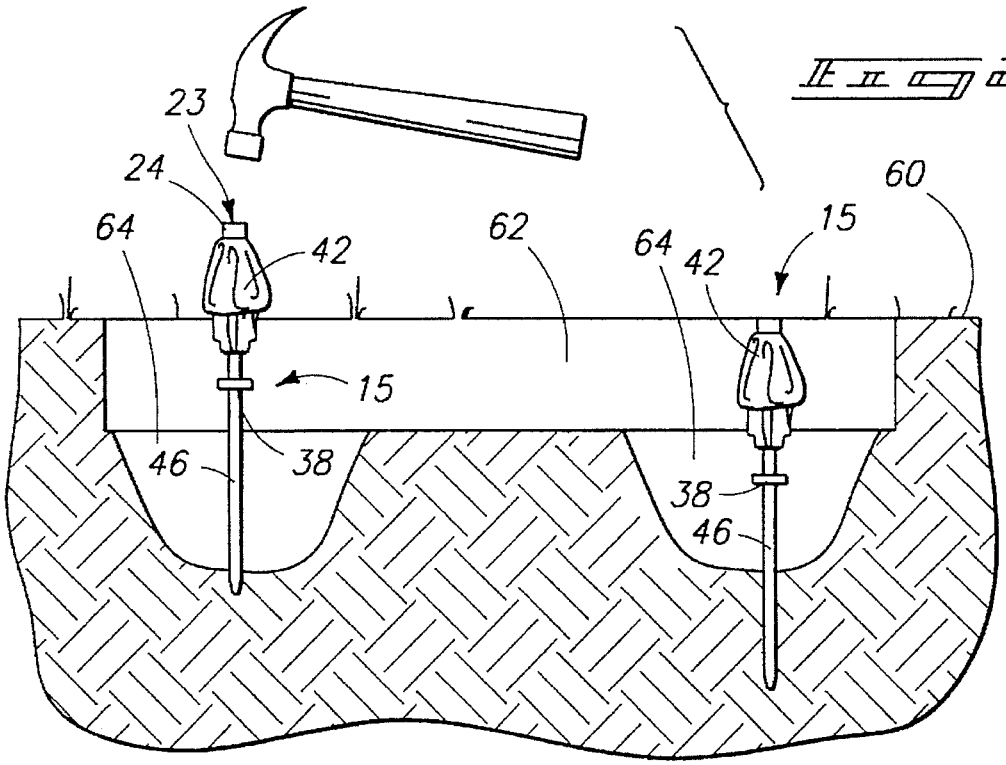
FIG. 2 is a view in progression from FIG. 1 showing installation of the presently preferred leveling devices.
Figure 3:
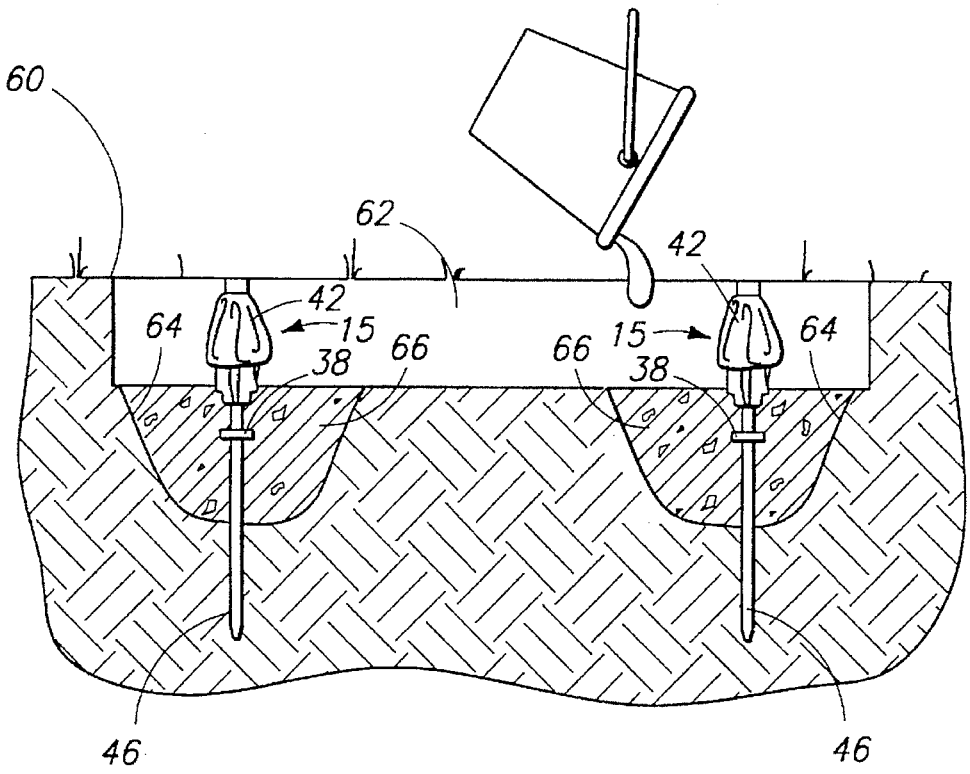
FIG. 3 is a view in progression from FIG. 2 showing pouring of concrete into the sub-footings.

The sub-footing depression or depressions 64 as shown, are excavated below the level of the footing depression 62 to a depth below the ground surface and surrounding sward not greater than the overall length of the device 15. This is done so the tubular spike 46 can be driven into the ground in the center of the respective sub-footing depression and assume a self supporting position as shown in FIG. 2.

Another step in the preferred process includes positioning a device 15 as described above into each sub-footing depression 64. Again attention is drawn to FIG. 2 where a hammer is shown for completing this step. Of course other impact tools could be used as well. The device is driven into the ground to a level where the head 22 is approximately level with the ground surface and surrounding sward. Care should be taken at this point to be sure that the nut 38 is situated within the sub-footing depression 64 below the bottom level of the footing depression 62, as shown on the right hand side of FIG. 2.

Concrete sub-footings 66 are now poured into the sub-footing depressions 64 (FIG. 3) to a level along the rods 16 between the nuts 38 and the abutments 30. This assures that the nuts 38 and their areal anchoring surfaces 40 will be immovably captured by the sub-footings 66 when cured.

Now the flexible liquid impervious sheets 42 may be folded out to cover the concrete sub-footings 66. This prevents the sub-footings 66 from bonding with the footings 68 to be poured in the next step.

Figure 5:
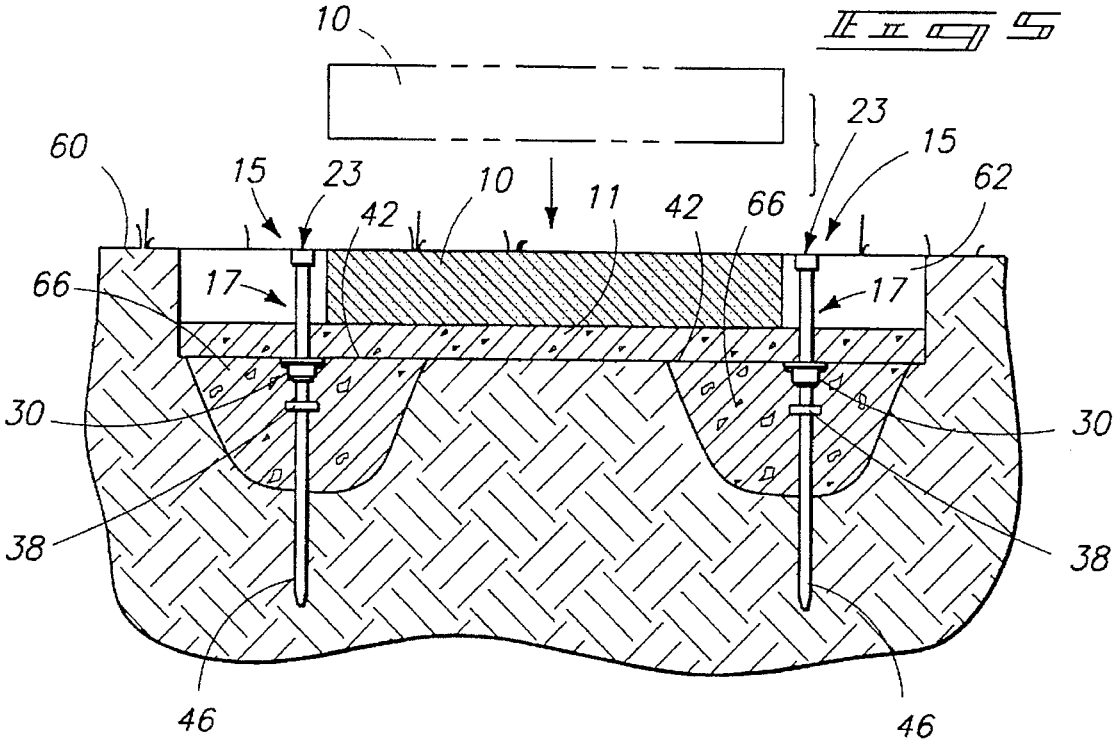
FIG. 5 is a view in progression from FIG. 4 showing placement of a grave marker on the footing.
Figure 6:
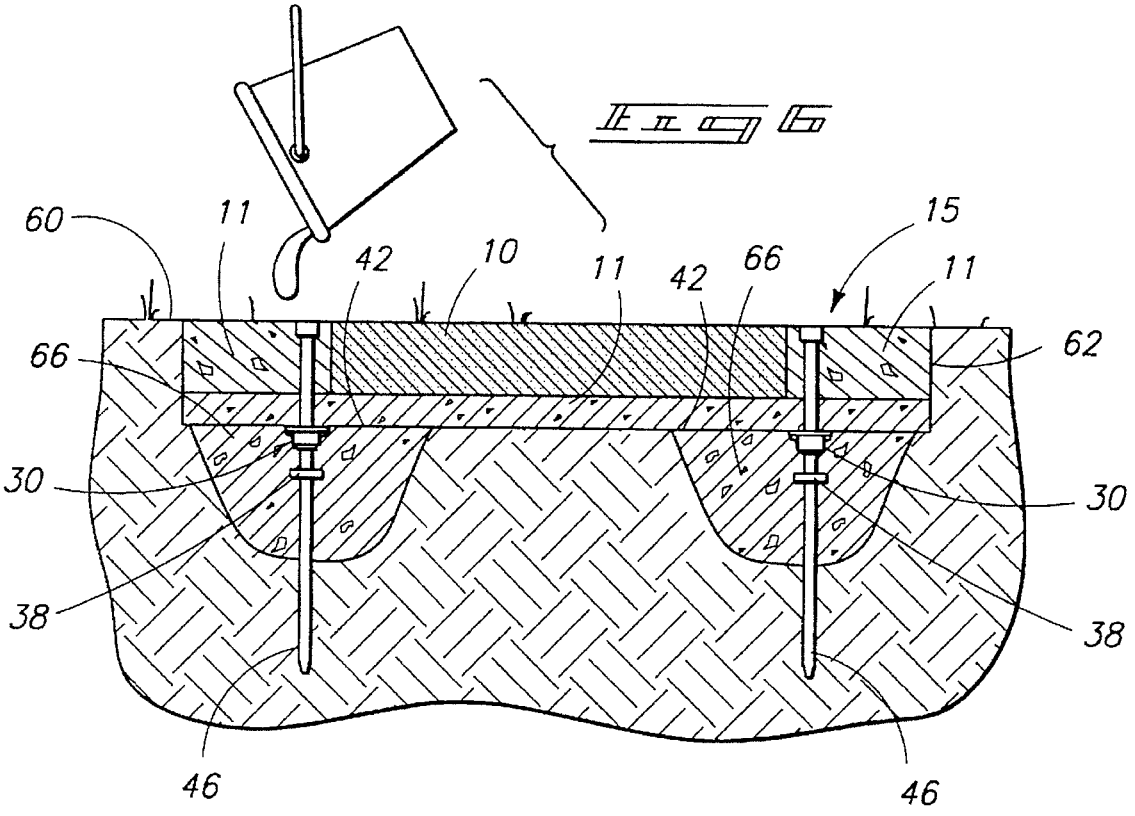
FIG. 6 is a view in progression from FIG. 5 showing completion of the footing pour.

A wet concrete footing 11 is poured over the sheet to the level of the tool engagement head. This step may be accomplished first by pouring concrete into the footing depression 62 to a desired level below ground level (FIG. 4), then finishing the pour after the step of setting the marker 10 in the footing 11 (FIG. 5). By doing this, the marker 10 can be accurately positioned with its top surface coplanar with the ground surface, and a layer of concrete is provided below the marker to unify the footing 11. This completes the setting process.

If the combination 54 (which includes the marker, footing and device) is to be used, the steps above are varied accordingly. For example, the step of pouring the footing 11 may be accomplished at the monument service or other site, using a form 56 to receive the footing pour and support the concrete until cured with the marker 10 and devices 15 in place. Appropriate holes 58 can be provided in the form 56 to receive, position and stabilize the devices 15 in position as the footing 11 is poured. Such positioning assures the upright nature of the devices 15 in the form 56, and proper location of the heads 22 at the top level of the footing. The form 56 can be removed after the footing has cured. The combination 54 is now ready for setting at the grave site.

The excavation step for the combination 54 is different slightly, since the footing depression 62 need only be excavated to a depth equal to the thickness of the combination 54 (since the footing 11 is already combined with the marker 10). Also, it may be desirable to excavate the sub-footing depressions 64 somewhat deeper, since the devices are supported in the footing and do not require driving into the ground surface.

When using the combination 54, the positioning step is automatically accomplished directly after filling the sub-footing depressions 64 with wet concrete, simply by lowering the combination 54 into the excavation. The downwardly projecting parts of the devices 15 in the combination 54 will become embedded in the wet sub-footings 66, and the nuts 38 will be captured as described above. The sheets 42 may be used as described above to prevent the wet sub-footings 64 from bonding with the footing 62.

Figure 11:
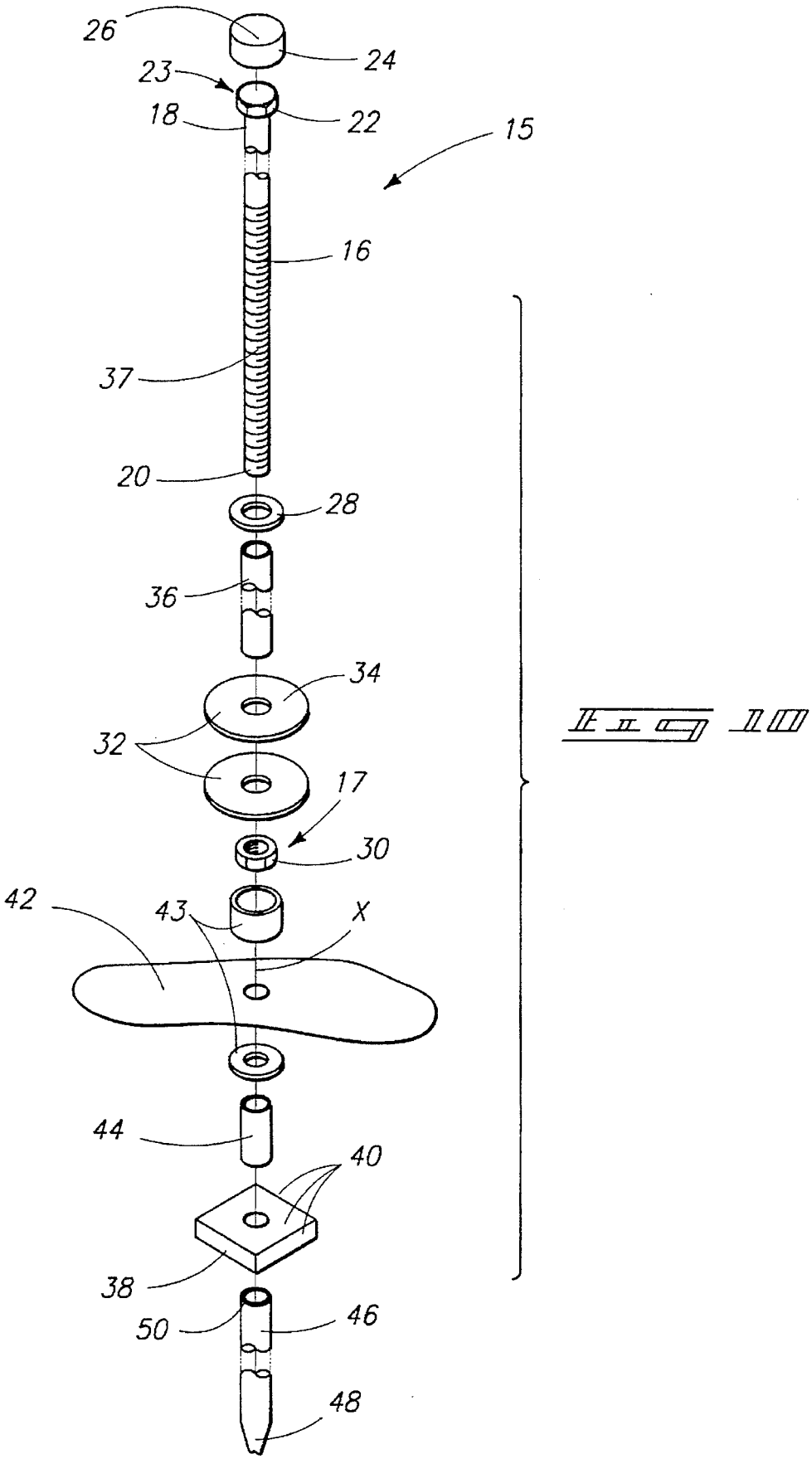
FIG. 11 is a view of the preferred leveling device in use to level a grave marker in an in-situ situation where the marker and footing were previously set without the present leveling device.
Figure 11:
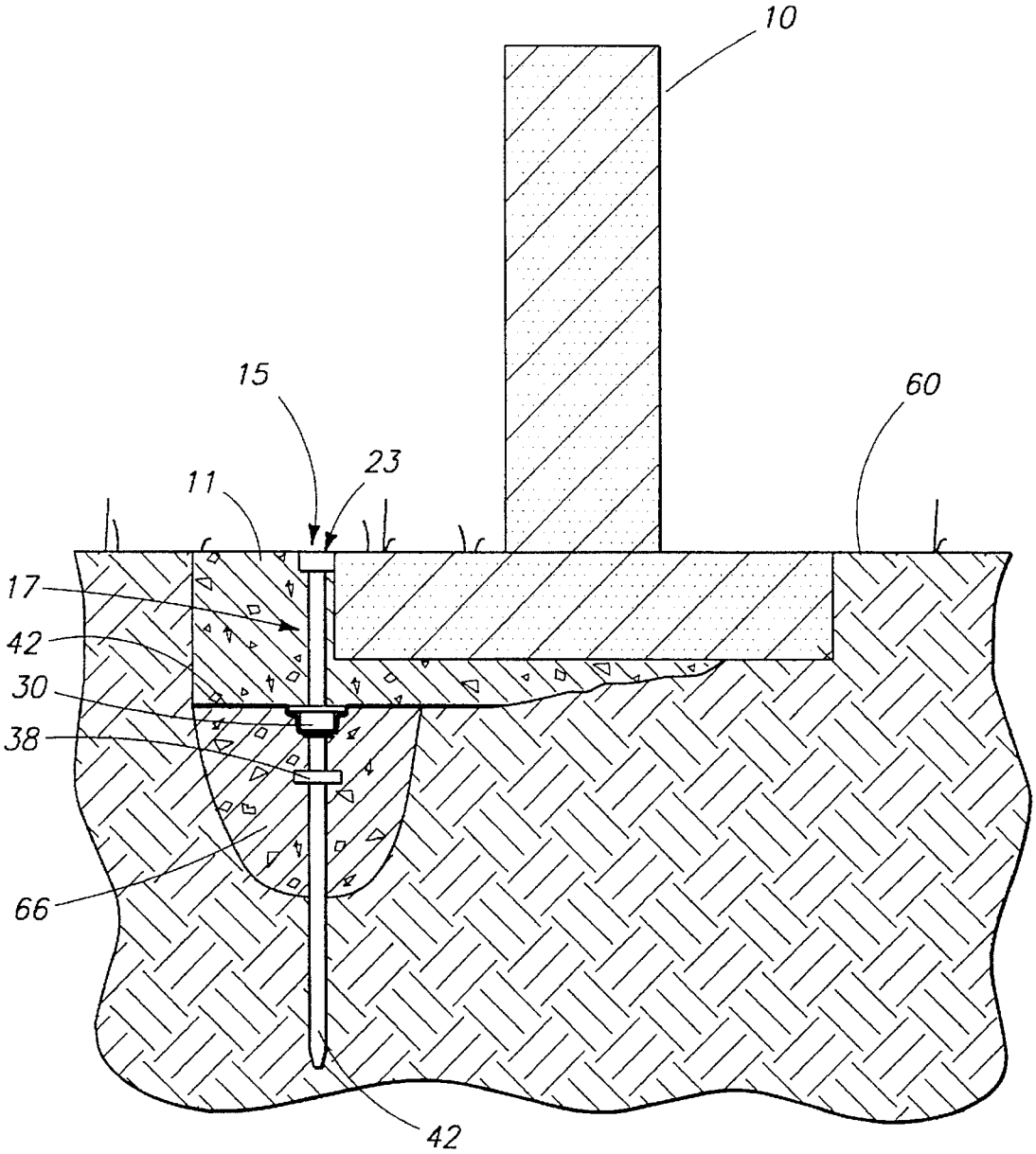

FIG. 11 illustrates a situation in which the device 15 is used in-situ to level an existing, previously set grave marker. Here the footing and sub-footing depressions are excavated adjacent to the marker. It may also be desirable to excavate an undercut below part of the marker to provide a shelf against which the device may operate in the leveling procedure. The placement of the device and pouring steps may then be accomplished as described above.

Once the concrete forming the sub-footing 64 and the footing 11 has cured, the device is ready for use. Normally, there will be a relatively extended period of time before there is need for the leveling devices, as the settling process usually progresses slowly. However, when settling does occur, the steps illustrated in FIGS. 7 and 8 may be used to re-level the marker and footing. It is noted at this point that regardless of the amount of leveling required, no part of the device will be left projecting above the level of the footing. The heads 22 will always remain at the same level with respect to the footing.

Figure 7:
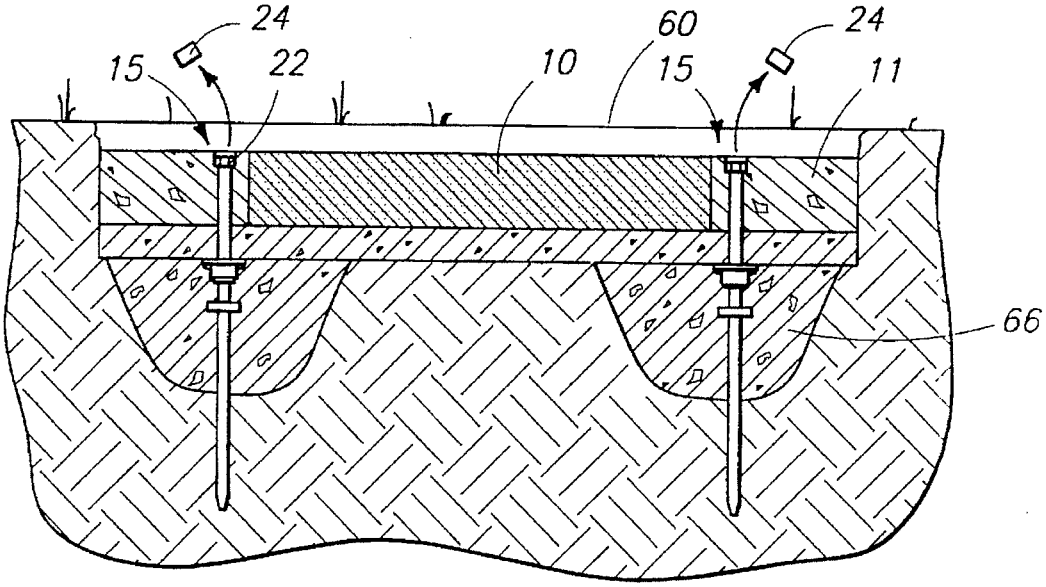
FIG. 7 is a view showing the preferred assembly in a settled situation, and removal of caps used to cover tool-accessible heads of the leveling devices.
Figure 8:
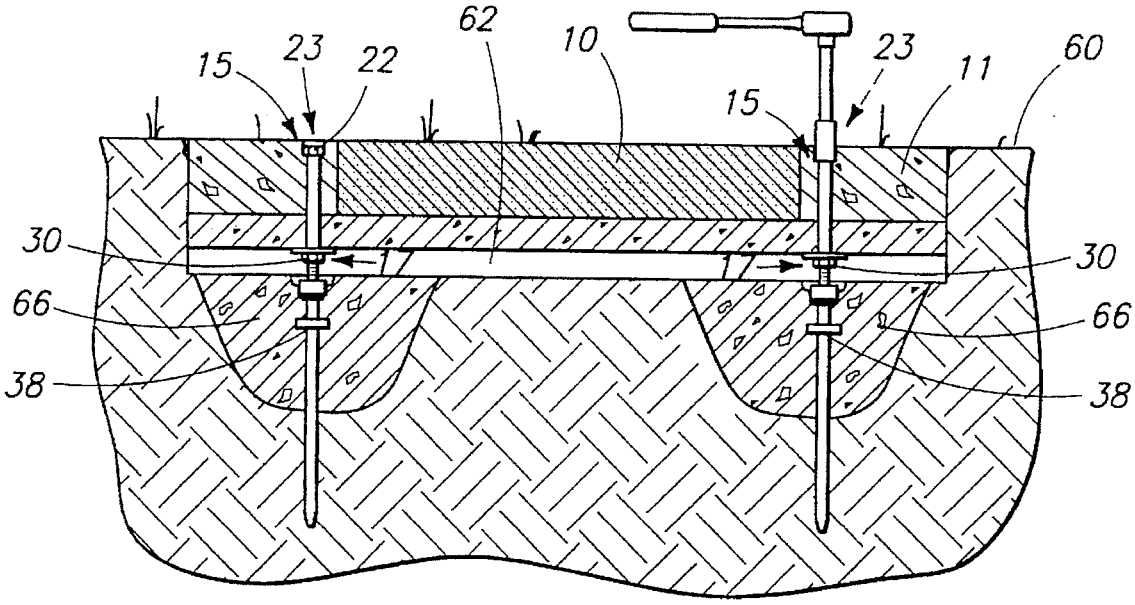
FIG. 8 is a view showing a turning tool being used with the presently preferred leveling devices to re-level the stone and footing.

To re-level a settled marker and footing, as exemplified in FIG. 7, the user simply removes the caps 24 to expose the heads 22. An ordinary turning tool such as the wrench shown in FIG. 8 may now be used to selectively rotate the rods 16. As the rods rotate, the threads 37 turn in the nuts 38. The nuts 38 are anchored in the sub-footings 64 and will not rotate. The rod must therefor move up or downwardly according to the direction of rotation. Turning motion in one direction will lift the abutment 30 (which is affixed to the rod) and the lifting washers 32 against the footing and marker. The result is that the footing and marker are lifted up from the sub-footings, according to the number of turns of the rods. Opposite rotation of the rods will result in lowering the footing and marker (though such operation The footing and marker can thus be leveled once again to with the ground surface. This process can be repeated if further settling occurs.

The same basic operational procedure can be used to right or level a marker that has been previously positioned (FIG. 11) without the leveling devices. Here, the installed device 15 works with the footing 11 and sub-footing 64 to lift a corner or edge of the settled marker. It should be noted that though one device is shown in FIG. 11, more could be used as required.

From the above, it may be readily understood that the present method and device will enable perpetual periodic leveling of a grave marker as the need arises, and that such leveling may be accomplished from above the ground surface using ordinary turning tools. Further, such adjustments are easily and quickly accomplished without disturbing the sward or disrupting the tranquility of the surrounding area. Still further, the leveling procedures can be accomplished without leaving any part of the device projecting above the level of the footing or marker, so as not to interfere with maintenance operations in the area.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A grave marker and grave marker footing leveling device, comprising:

an elongated rod extending along an axis from a top end to a bottom end;

a tool engagement head at the top end of the rod;

a footing lifting abutment on the rod spaced toward the bottom end from the tool engagement head;

threads formed in the rod between the abutment and the bottom end;

a nut threadably engaged with the threads and spaced toward the bottom end from the abutment;

areal concrete anchoring surfaces on the nut; and a tubular spike rotatably receiving and covering an axial length of the rod from the nut to the bottom end of the rod.

2. A grave marker and grave marker footing leveling device, as claimed by claim 1, further comprising:

at least one footing engaging and lifting washer rotatably mounted to the rod and movably supported by the abutment.

3. A grave marker and grave marker footing leveling device, as claimed by claim 1, further comprising:

a flexible liquid impervious sheet mounted to the rod between the nut and abutment, foldable to a flattened condition substantially normal to the axis.

4. A grave marker and grave marker footing leveling device, as claimed by claim 1, further comprising a spacer tube rotatably encircling the rod and extending between the abutment and nut.

5. A grave marker and grave marker footing leveling device, as claimed by claim 1, wherein the tubular spike includes a closed, pointed bottom end adapted to be driven into a ground surface.

6. A grave marker and grave marker footing leveling device, as claimed by claim 1, further comprising a tubular shield extending axially along the rod from the abutment to the head.

7. A grave marker and grave marker footing leveling device, as claimed by claim 1, further comprising a liquid impervious cap slidably received axially over the head and having a closed end to releasably cover the head and to prevent formation of concrete against the head.

8. A grave marker and grave marker footing leveling device, as claimed by claim 1, further comprising:

a washer on the rod below the head; and a tubular shield extending axially along and rotatably receiving the rod from the abutment to the washer.

9. A grave marker and grave marker footing leveling device, as claimed by claim 1, further comprising:

at least one footing engaging and lifting washer rotatably mounted to the rod and movably supported by the abutment;

a flexible liquid impervious sheet mounted to the rod between the nut and abutment, foldable to a flattened condition substantially normal to the axis;

a spacer tube rotatably encircling the rod and extending between the abutment and nut;

wherein the tubular spike includes a closed, pointed bottom end adapted to be driven into a ground surface;

a tubular shield extending axially along the rod from the abutment to the head;

a liquid impervious cap slidably received axially over the head and having a closed end to releasably cover the head and to prevent formation of concrete against the head;

a washer on the rod below the head; and a tubular shield extending axially along and rotatably receiving the rod from the abutment to the washer.

10. A grave marker and footing with a leveling device, comprising:

a grave marker;

a grave marker footing mounting the grave marker, including a top surface;

an elongated rod extending along an axis from a top end through the grave marker footing to a bottom end situated below the footing;

a tool engagement head at the top end of the rod, positioned adjacent to the top surface of the grave marker footing;

a footing lifting abutment on the rod, engaging either one of the grave marker or grave marker footing, and spaced toward the bottom end from the tool engagement head;

threads formed in the rod between the abutment and the bottom end;

a sub-footing immediately below the grave marker footing;

a nut anchored within the sub-footing and threadably engaged with the threads and spaced toward the bottom end from the abutment; and a tubular spike rotatably receiving and covering an axial length of the rod projecting into the sub-footing from the nut to the bottom end of the rod;

whereby the head may be selectively turned to vary axial spacing between the sub-footing and the footing such that the footing and grave marker may be elevationally adjusted with respect to an adjacent ground surface in which the footing and sub-footing are placed, to compensate for settling.

11. The device as claimed by claim 10, further comprising:

at least one footing engaging and lifting washer rotatably mounted to the rod and movably supported by the abutment.

12. The device as claimed by claim 10, further comprising:

a flexible liquid impervious sheet mounted to the rod between the nut and the abutment, and separating the footing and the sub-footing thereby enabling selective axial separation of the footing from the sub-footing responsive to rotation of the head.

13. The device as claimed by claim 10, further comprising a spacer tube rotatably encircling the rod and extending between the abutment and the nut.

14. The device as claimed by claim 10, wherein the tubular spike includes a closed, pointed bottom end projecting downwardly from the sub-footing and adapted to be driven into a ground surface.

15. The device as claimed by claim 10, further comprising a tubular shield extending axially through the footing and rotatably encasing the rod from the abutment to the head.

16. The device as claimed by claim 10, further comprising a liquid impervious cap slidably received axially over the head and having a closed end to releasably cover the head and to form a head receiving recess in the footing.

17. A grave marker and footing with a leveling device, comprising:

a grave marker set in a grave marker footing, including a top surface and an opposed bottom surface;

an elongated rod extending along an axis from a top end through the grave marker footing to a bottom end situated below the footing, and rotatable about the axis within the grave marker footing;

a tool engagement head at the top end of the rod, positioned adjacent the top surface of the grave marker footing adapted for access by a turning tool;

a footing lifting abutment on the rod, engaging the bottom surface;

threads formed in the rod between the abutment and the bottom end;

a nut threadably engaged along the threads and spaced toward the bottom end from the abutment; and a tubular spike rotatably receiving and covering an axial length of the rod from the nut to the bottom end.

18. A process for setting a grave marker and grave marker footing leveling device, comprising:

excavating a grave marker ground site to include a footing receiving depression and a sub-footing depression within the footing receiving depression;

pouring a concrete sub-footing into the sub-footing depression;

positioning an elongated rod in the sub-footing depression, the rod extending along an axis from a top end to a bottom end and having a tool engagement head at the top end of the rod, a footing lifting abutment on the rod spaced toward the bottom end from the tool engagement head, threads formed in the rod between the abutment and the bottom end, a nut threadably engaged with the threads and spaced toward the bottom end from the abutment, and a tubular spike rotatably receiving and covering an axial length of the rod from the nut to the bottom end of the rod; and providing in the footing depression, a grave marker with a footing rotatably encasing an axial extent of the rod between the head and the footing lifting abutment and with the nut embedded within the sub-footing in such a manner that rotation of the rod will produce a reaction between the sub-footing and the grave marker and the footing such that the grave marker and the footing will move elevationally.

19. A process for setting a grave marker and grave marker footing leveling device as claimed by claim 18, comprising the further step of:

placing a flexible liquid impervious sheet over the concrete sub-footing.

20. A process for setting a grave marker and grave marker footing leveling device as claimed by claim 18, wherein the step of providing a grave marker and footing includes the steps of:

positioning the rod in the sub-footing prior to pouring concrete into the sub-footing depression, in an upright position and with the nut positioned within the sub-footing depression and the abutment and head within the footing depression;

placing a liquid impervious sheet over the sub-footing; and pouring a concrete footing over the sub-footing and rod along an axial extent of the rod between the abutment and tool engagement head.

21. A grave marker and footing leveling device enabling selective periodic leveling of the grave marker from above an adjacent ground surface, comprising:

a grave marker;

a grave marker lifting member engageable with the grave marker to impart elevational movement thereto;

a stationary footing member mounting the grave marker lifting member for selective elevational movement relative to the ground surface; and a ground surface operator connected to the grave marker lifting member, and positionable adjacent the ground surface for operation from above the ground surface to selectively move the grave marker engaging member and grave marker elevationally relative to the adjacent ground surface.

* * * * *